United States Patent [19]

Levy et al.

[11] 4,043,141

[45] Aug. 23, 1977

[54] AIR CONDITIONING METHOD AND APPARATUS WITH HUMIDIFIER

[75] Inventors: Hans Levy; John Alan Schade, both of Cherry Hill, N.J.

[73] Assignee: A. C. Manufacturing Company, Cherry Hill, N.J.

[21] Appl. No.: 661,722

[22] Filed: Feb. 26, 1976

[51] Int. Cl.[2] ..... F25D 17/06; F28C 1/00; B01D 47/00; C10T 1/10

[52] U.S. Cl. ..... 62/91; 62/121; 62/315; 261/106

[58] Field of Search ..... 62/91, 121, 304, 315; 261/105, DIG. 15, 103

[56] References Cited

U.S. PATENT DOCUMENTS

| | | | |
|---|---|---|---|
| 2,158,294 | 5/1939 | Long | 261/106 |
| 2,295,983 | 9/1942 | Williams | 62/91 |
| 3,075,750 | 1/1963 | Goettl | 261/106 |
| 3,146,609 | 9/1964 | Engalitcheff, Jr. | 62/121 |
| 3,739,597 | 6/1973 | Schulze, Sr. | 62/91 |
| 3,747,362 | 7/1973 | Mercer | 62/121 |
| 3,890,797 | 6/1975 | Brown | 62/91 |

*Primary Examiner*—Lloyd L. King
*Attorney, Agent, or Firm*—Robert K. Youtie

[57] ABSTRACT

The combination with an air conditioning system including compressor, condenser and evaporator, with a humidifier for humidifying conditioned air and a heat exchanger for transferring heat between hot refrigerant of the air conditioning system and water supplied to the humidifier.

7 Claims, 2 Drawing Figures

FIG. 1
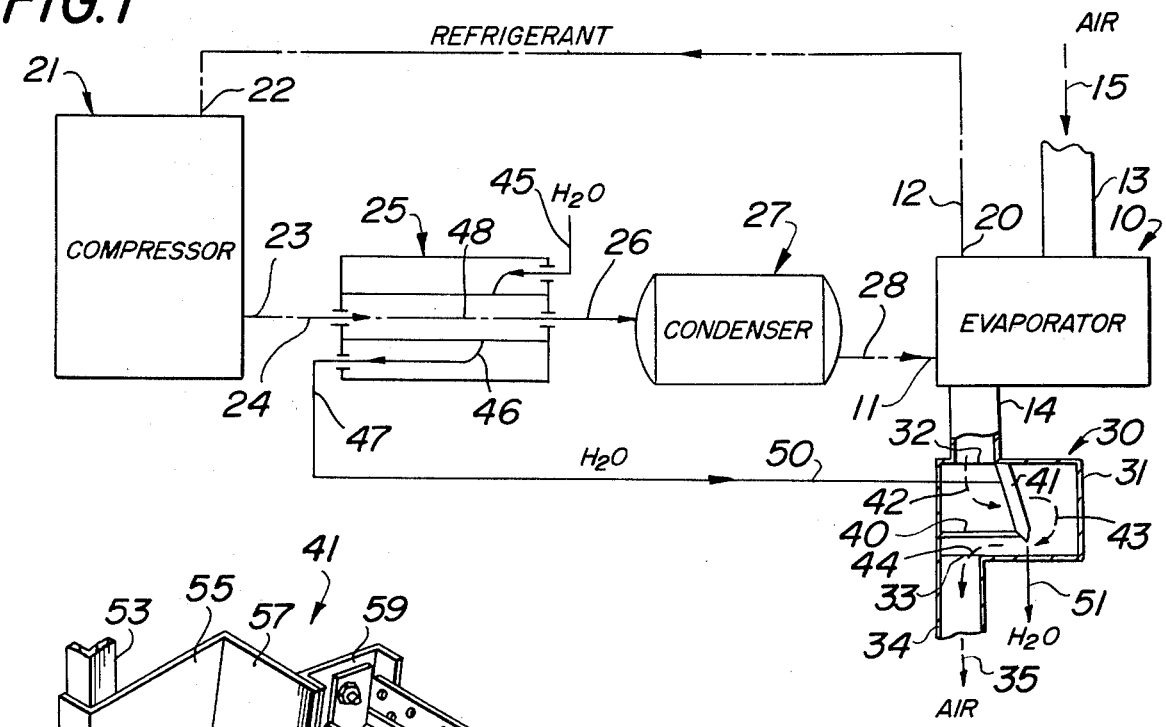
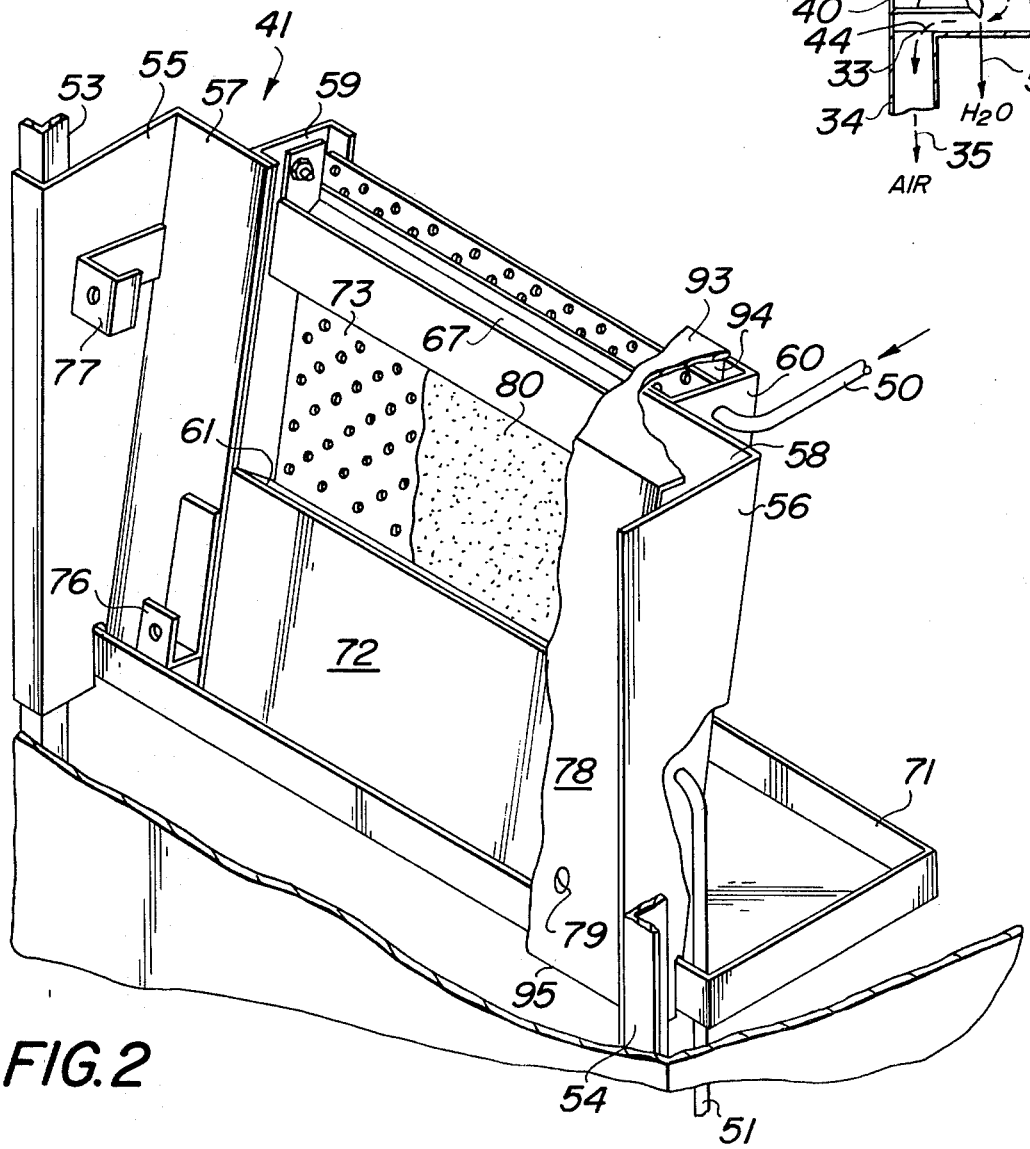
FIG. 2

AIR CONDITIONING METHOD AND APPARATUS WITH HUMIDIFIER

BACKGROUND OF THE INVENTION

In certain environmental control installations, it may be required to cool and humidify the air being conditioned. Heretofore, this has been achieved relatively inefficiently by pan or liquid pool type humidifiers utilizing available water without heating the latter. It has also been the usual practice to dissipate and waste the heat removed from the conditioned air, without using the same.

SUMMARY OF THE INVENTION

It is, in accordance with the present invention, an important object to effectively increase the efficiency of energy utilization in an air conditioning system requiring humidification of the conditioned air by the incorporation therein of a water-curtain type of humidifier employing water heated by heat removed from the air.

It is another object of the present invention to provide an air conditioning system and method of the type described which is extremely simple in structure and operation, highly reliable throughout long periods of use, and which can be incorporated in otherwise conventional air conditioning systems at relatively little initial cost and effecting substantial savings in continuing operating costs.

Other objects of the present invention will become apparent upon reading the following specification and referring to the accompanying drawings, which form a material part of this disclosure.

The invention accordingly consists in the features of construction, combinations and arrangements of parts and method steps, which will be exemplified in the following description, and of which the scope will be indicated by the appended claims.

BRIEF DESCRIPTION OF THE DRAWINGS

FIG. 1 is a diagrammatic view illustrating a method and apparatus of the present invention.

FIG. 2 is a top perspective view showing a humidifier adapted for use in practice of the present invention, the humidifier being partly broken away to better illustrate structural features.

DESCRIPTION OF THE PREFERRED EMBODIMENT

It should be appreciated that the present invention is concerned with an overall combination of elements in an air conditioning system, including a heat exchanger for removing heat from relatively hot refrigerant to water, and a humidifier for utilizing the heated water to increase humidity. By way of illustration, one humidifier well adapted for use in conjunction with the present invention is that of applicant's prior U.S. Pat. No. 3,778,042 which has, in use, been found highly advantageous. However, it is appreciated that other humidifiers may be employed in the instant invention, although preferably limited to the general type herein called water-curtain humidifiers, such as that of said patent, spray humidifiers and the like wherein the water is passed through air, as opposed to the water pool or pan type humidifier wherein the air merely passes over the surface of a pool of standing water.

Referring now more particularly to the drawings, and specifically to FIG. 1 thereof, an air conditioning system of the present invention is schematically illustrated therein including a refrigerant evaporator 10 having an inlet 11 for condensed refrigerant and an outlet 12 for evaporated refrigerant. The evaporator 10 may be a conventional evaporative heat exchanger located in a stream of air being conditioned. Thus, an air inlet 13 for warm air communicates with the evaporator 10, as does an air outlet 14, for cooled air. A supply of inlet air is shown at 15, being designated by dashed arrows.

The refrigerant path is diagrammatically designated by dot-and-dash arrows, passing from the refrigerant outlet 20 of evaporator 10, along refrigerant path 12 to a refrigerant compressor 21, entering the latter at a refrigerant inlet 22. In conventional manner, the compressor 21 raises the pressure of refrigerant and discharges pressurized refrigerant at 23 for transmission along refrigerant line 24 to a heat exchanger 25.

That is, pressurized refrigerant exiting compressor 21 at outlet 23 is relatively hot, and in this condition passes to heat exchanger 25 where heat is removed from the refrigerant for purposes appearing more fully hereinafter.

Refrigerant egress from heat exchanger 25 is indicated at 26, passing thence to refrigerant condenser 27. By the condenser 27 the pressurized and cooled refrigerant is condensed for passage at 28 to the evaporator 10 for repeated evaporation and cooling of air 15.

The air conditioning cycle of refrigerant compressing, condensing and evaporating is conventional and well known. In certain air conditioning systems there is a requirement for the cooled air to be humidified. Toward this end a humidifier, generally designated 30, is interposed in the air stream 15, downstream of the evaporator 10. Specifically, the humidifier 30 may include an outer casing, housing or enclosure 31 having an air inlet opening 32 communicating with the air outlet opening 14 of evaporator 10. Spaced from the air inlet opening 32, the housing or enclosure 31 may be provided with an air outlet opening 33, from which may extend an air outlet or duct 34 for the removal or egress of humidified air, as at 35.

The humidifier 30 is operationally of the water-curtain type wherein water moves through or across the air stream, in contradistinction to the pan type wherein air moves over the surface of standing water. While any water-curtain type may be employed, including spray humidifiers, it has been found highly advantageous to employ a humidifier of the type shown in U.S. Pat. No. 3,778,042 utilizing a pervious sheet for transmitting liquid across the air stream.

In the diagrammatic representation of FIG. 1, a horizontal wall, partition or baffle 40 extends within the enclosure 31 partially thereacross in spaced relation between the inlet and outlet openings 32 and 33. Further, a pervious sheet assembly 41 extends in generally upright, inclined relationship between the partition 40 and the upper and side walls of the enclosure 31. As the pervious sheet or curtain assembly 41 permits the passage therethrough of air, it will be appreciated that the air stream 15 proceeds downwardly through outlet or conduit 14 and inlet opening 32 into the housing 31, as at arrow 42, thence through the pervious sheet or curtain assembly 41, as at arrow 43, and subsequently about baffle or partition 40 and downwardly through outlet opening 33 and conduit 34, as at arrow 44.

The heat exchanger 25 is advantageously of counterflow type. From a supply source, water may enter the exchanger 25, as at 45 and flow therethrough, as at 46, exiting at 47. The hot compressed refrigerant enters the heat exchanger 25 at 24, flows through the exchanger, as at 48, and exits at 26. Thus, it will be apparent that the fluid flows through heat exchanger 25 in counter-current relation, the water being heated at its exit 47 and the refrigerant is cooled at its exit 26.

The heated water passes from the exchanger 25, as at 50, to the water-curtain assembly 41, being transmitted thereby across the air stream 42, 43 for humidifying the latter, with the remaining liquid exiting, as at 51.

Considering the pervious sheet or water-curtain assembly 41 in greater detail, as shown in FIG. 2, there may be provided a pair of laterally spaced upright frame members, as at 53 and 54, for fixed mounting in the enclosure 31. A pair of laterally spaced angle members 55 and 56 extend obliquely upwardly, being respectively fixed by suitable securing means to frame members 53 and 54. The angle members 55 and 56 extend in facing parallelism with each other obliquely upwardly and have generally coplanar flanges 57 and 58 extending laterally toward and spaced from each other. Extending along and fixedly secured to the coplanar flanges 57 and 58, on the inner or interior surfaces thereof, are respective channels 59 and 60 which extend in facing spaced parallelism with each other. In the lower region of the space between facing channels 59 and 60, there is disposed an upwardly facing collector or trough 61 which extends horizontally between and has its opposite ends suitably fixed to respective channels 59 and 60. The trough or collector 61 may have a generally V-shaped cross section in its lower region.

In spaced relation over the lower region of the trough 61 is a generally horizontally disposed feeder or upper trough 67, which is located adjacent to the inner or upstream flanges of channels 59 and 60, so as to be upstream of and above the lower trough 41, by reason of the upstream inclination of the channels. Extending between the upper regions of channels 59 and 60, and being suitably fixed thereto, the feeder trough 67 is provided with a plurality of downwardly opening apertures or feed holes. Thus, the horizontally extending collector trough 61 and the upper feed trough 67 are spaced vertically from each other, and suitable feed conduit means 50 is connected to the feeder trough while suitable drain conduit means 51 is connected to the collector trough. The feed conduit 50 is connected through the heat exchanger 25 to a source of liquid or water and, a constant flow regulator or valve of any suitable type may be interposed in the water line, if desired. Such valve may be operated by humidity sensing means, if desired.

Beneath the lower and upper troughs 61 and 67, there may be provided a drain pan 71, say fixed to the lower ends of flanges 57 and 58, and which may communicate with the outlet conduit 51 for collecting and disposing of spilled liquid and the like. A closure member or plate 72 may extend laterally between lower regions of the flanges 57 and 58, suitably fixed thereto, and generally vertically between the pan 71 and the upper edge of collection trough 61.

Extending in generally upright relation, inclined in the upstream direction of air flow, between the facing channels 59 and 60, is an open support 73, such as a reticulate sheet or perforate plate. The support sheet 73 may rest in the trough or collector 41, extending obliquely upwardly and inwardly therefrom in the upstream direction with its opposite side edge margins resting on the inner flanges of channels 59 and 60, and terminating proximate to the upper feeder or trough 67. The support member or plate may be fixed in position as described above, or removably supported, the latter permitting of easier cleaning and replacement.

Suitable cover mounting means are provided, as by a pair of lower brackets 76 projecting outwardly from the lower region of respective flanges 57 and 58, and a pair of upper brackets 77 projecting outwardly from upper regions of the members 55 and 56. A cover member or sheet 78 is disposed in facing relation with the reticulate support plate 73, spaced on the downstream side thereof and extending entirely across between the angle members 55 and 56. The cover member 78 is secured in position against the brackets 76 and 77, as by screw fasteners 79 extending through the cover threadedly into brackets 76, or other suitable securing means. Further, the cover 58 includes a top wall 93 extending upstream over the space between facing channels 59 and 60, and further includes a closure member or depending extension 94 depending to a level below the top of upper trough or feeder 67. By this means, the upper trough or feeder 67 is excluded from direct communication with the upstream side of the humidifier, to prevent the carry-over of liquid by air directly from the feeder trough into the air stream. Further, the lower downstream edge 95 of the closure 78 is located adjacent to but spaced from the plate 72, so as to constrict and effectively minimize the passage of air through the reticulate support 73 to a desired degree.

Removably supported by the reticulate support member or plate 73 is a generally rectangular sheet 80 of porous or pervious material, such as a filter element of plastic or foam, or the like. The porous sheet or filter element 80 may be of a configuration to substantially completely cover the open work or perforate support plates 73, having its upper edge immediately beneath and spaced from the under side of feeder trough 67 for receiving liquid from the feeder. The liquid received at the upper edge of the filter sheet 80 passes downwardly through the open-cell material of the filter, and the lower filtered edges disposed within or directly over and in downwardly facing relation with respect to the upwardly opening collector trough 61 for gravitationally discharging liquid to the collector trough. Suitable means are provided to maintain the filter 80 in its upright position as illustrated, to resist buckling and sagging even under the weight of contained liquid and the force of moving air, while permitting of convenient removal and replacement, as desired. Such means may be seen in said prior U.S. Pat. No. 3,778,042.

From the foregoing, it will now be appreciated that the instant invention provides an air conditioning system including humidification of conditioned air which is of greatly enhanced efficiency and effectiveness by utilization of waste heat to effect greater humidification at reduced expense for energy and equipment.

Although the present invention has been described in some detail by way of illustration and example for purposes of clarity of understanding, it is understood that certain changes and modifications may be made within the spirit of the invention.

What is claimed is:

1. In an air conditioning system with humidifier including a refrigerant compressor, condenser and evaporator connected in fluid communication; the improvement comprising a humidifier having water inlet and discharge means and located in an air stream being conditioned to humidify the latter, a separate heat exchanger connected in fluid communication with and between said compressor and condenser downstream of the compressor and upstream of the condenser for passing hot refrigerant therebetween and having water passage means in heat receiving relation with hot refrigerant, water supply means connected to one end of said water passage means, and water conduit means connected between the other end of said water passage means and the inlet of said humidifier for passing heated water to said humidifier for enhanced humidification by removed heat.

2. An air conditioning system according to claim 1, said humidifier being of the water-curtain type for relatively great humidification by relatively little increase in water temperature.

3. An air conditioning system according to claim 1, said humidifier including a liquid permeable sheet extending across the air stream and interposed edgewise between said water inlet and discharge means.

4. An air conditioning system according to claim 1, said heat exchanger being a counter-flow gas-to-liquid heat exchanger.

5. In the method of air conditioning and humidifying the medium of a zone, the steps which comprise: evaporating a refrigerant in heat transferring relation with the medium of said zone to absorb the heat from the medium of said zone, pressuring the evaporated refrigerant out of heat transferring relation with the medium of the zone to heat the refrigerant, condensing the pressurized refrigerant out of heat transferring relation with the medium of the zone to prepare for repeated evaporation, passing water in heat receiving relation with the pressurized refrigerant to heat the water, and passing the heated water to the medium of the zone to humidify the medium of the zone.

6. The method according to claim 5, further characterized in passing the heated water through a curtain type humidifier to humidify the medium of the zone.

7. The method according to claim 6, further characterized in passing said medium of the zone through the humidifier.

* * * * *